US011043738B2

(12) United States Patent
Yu et al.

(10) Patent No.: US 11,043,738 B2
(45) Date of Patent: Jun. 22, 2021

(54) DUAL-POLARIZED RADIATING ELEMENT, ANTENNA, BASE STATION, AND COMMUNICATIONS SYSTEM

(71) Applicant: Huawei Technologies Co., Ltd., Shenzhen (CN)

(72) Inventors: Yanmin Yu, Shenzhen (CN); Chen Huang, Shenzhen (CN); Zihui Liu, Dongguan (CN); Ming Yang, Dongguan (CN); Jian Song, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 21 days.

(21) Appl. No.: 16/698,442

(22) Filed: Nov. 27, 2019

(65) Prior Publication Data

US 2020/0099128 A1 Mar. 26, 2020

Related U.S. Application Data

(63) Continuation of application No. PCT/CN2017/086832, filed on Jun. 1, 2017.

(51) Int. Cl.
*H01Q 1/38* (2006.01)
*H01Q 1/48* (2006.01)
(Continued)

(52) U.S. Cl.
CPC ..... *H01Q 1/38* (2013.01); *H01Q 1/48* (2013.01); *H01Q 19/17* (2013.01); *H01Q 21/24* (2013.01)

(58) Field of Classification Search
CPC ..... H01Q 1/38; H01Q 1/48; H01Q 19/17; H01Q 21/24; H01Q 9/28; H01Q 9/285; H01Q 25/001; H01Q 1/246
(Continued)

(56) References Cited

U.S. PATENT DOCUMENTS 6,621,384 B1 9/2003 Handforth et al.
7,283,101 B2 10/2007 Bisiules et al.
(Continued)

FOREIGN PATENT DOCUMENTS

CN 1591976 A 3/2005
CN 101505007 A 8/2009
(Continued)

OTHER PUBLICATIONS

Zurcher, Jean-Francois, et al., "A New Power Divider Architecture for Suspended Strip Line," 6th European Conference on Antennas and Propagation (EUCAP), 5 pages.

*Primary Examiner* — Khai M Nguyen
(74) *Attorney, Agent, or Firm* — Slater Matsil, LLP

(57) ABSTRACT

This application provides a dual-polarized radiating element, an antenna, a base station, and a communications system. The dual-polarized radiating element includes: an insulated support structure with a solid structure, where the insulated support structure includes a top part, a base, and an intermediate supporting piece that connects the top part and the base; and at least two radiating arm groups conformal to the insulated support structure, and feeding mechanisms corresponding to the radiating arm groups; the feeding mechanism includes a balun and a feeding plate, one end of the balun is electrically connected to a corresponding radiating arm group, and another end of the balun is electrically connected to a ground layer; and the feeding plate is connected to an electric lead on the base of the insulated support structure.

19 Claims, 9 Drawing Sheets

(51) Int. Cl.
*H01Q 19/17* (2006.01)
*H01Q 21/24* (2006.01)

(58) Field of Classification Search
USPC ..... 343/700 MS
See application file for complete search history.

(56) References Cited

U.S. PATENT DOCUMENTS

| | | | | |
|---|---|---|---|---|
| 9,276,323 | B2 * | 3/2016 | Moon | H01Q 5/48 |
| 9,722,323 | B2 * | 8/2017 | Yona | H01Q 21/24 |
| 2017/0062940 | A1 | 3/2017 | Cao | |
| 2018/0191083 | A1 | 7/2018 | Daojian et al. | |

FOREIGN PATENT DOCUMENTS

| | | | |
|---|---|---|---|
| CN | 101673881 | A | 3/2010 |
| CN | 103746180 | A | 4/2014 |
| CN | 103779658 | A | 5/2014 |
| CN | 104143686 | A | 11/2014 |
| CN | 204793177 | U | 11/2015 |
| CN | 105449361 | A | 3/2016 |
| CN | 105896071 | A | 8/2016 |
| CN | 105990681 | A | 10/2016 |
| EP | 3166178 | A1 | 5/2017 |
| JP | 2016119551 | A | 6/2016 |
| KR | 20160008401 | A | 1/2016 |
| NO | 2018103822 | A1 | 6/2018 |
| WO | 2017035726 | A1 | 3/2017 |
| WO | 2017076714 | A1 | 5/2017 |

* cited by examiner

DUAL-POLARIZED RADIATING ELEMENT, ANTENNA, BASE STATION, AND COMMUNICATIONS SYSTEM

CROSS-REFERENCE TO RELATED APPLICATIONS

This application is a continuation of International Application No. PCT/CN2017/086832, filed on Jun. 1, 2017, which is hereby incorporated by reference in its entirety.

TECHNICAL FIELD

The present invention relates to the field of wireless communications technologies, and more specifically, to a dual-polarized radiating element, an antenna, a base station, and a communications system.

BACKGROUND

With the development of communication applications having high data traffic such as an internet of vehicles, an internet of things, and video on-live, a wireless communications network needs to obtain a higher throughput rate to meet a requirement for high data traffic communication. Currently, a most commonly used method is to add a new spectrum without changing spectral efficiency, or add more receiving/transmitting channels to a same frequency. To add a new spectrum, arrays for more frequency bands need to be integrated into a base station antenna; and to add more receiving/transmitting channels, more intra-frequency arrays need to be integrated into a base station antenna.

Currently, a radiating element in a base station antenna may be directly molded by using metal and implemented in coordination with feeding using an equivalent coaxial cable. There is a relatively large quantity of functional parts in this type of radiating element. Parts of a same type in different radiating elements differ relatively greatly in size and shape. Such size deviations affect electrical performance of the antenna, and the impact is more obvious as an operating frequency increases. In addition, this type of radiating element is connected to a feeding network by welding coaxial cables. If radiating elements multiply, welding joints also multiply. This not only increases difficulty in ensuring quality of the welding joints, but also significantly increases a probability of a PIM failure in a lifecycle of the antenna.

Alternatively, a radiating element in a base station antenna may function as a radiating element and a feeding unit by using a PCB technology. Although a quantity of functional parts in the radiating element is reduced by using the PCB technology, a form of the antenna is also limited to a specific extent. This increases difficulty in assembly and decreases freedom of antenna performance optimization. Moreover, this type of radiating element also needs to be connected to a feeding network by welding coaxial cables. This also encounters problems caused by welding joints.

On the other hand, currently, when a wireless network is deployed, in consideration that it is difficult to obtain a site for a new base station and a bearing capability of a single base station is limited, a new antenna is directly used to replace an old antenna in an existing network during actual wireless network deployment. Therefore, this has high requirements on antenna assembly, performance optimization freedom, and PIM effectiveness in the lifecycle. If the new antenna uses the foregoing radiating element, a requirement of the new antenna on a new base station can hardly be met.

SUMMARY

Embodiments of this application provide a dual-polarized radiating element, an antenna, a base station, and a communications system, to resolve a prior-art problem that a requirement on a new base station cannot be met due to an increase in difficulty of antenna assembly caused because a radiating element has a relatively large quantity of constituent components and a complex structure.

To achieve the foregoing objective, this application provides the following technical solutions.

According to a first aspect, a dual-polarized radiating element is provided. The dual-polarized radiating element is applied to an antenna, and includes: an insulated support structure, where the insulated support structure is a solid structure, and includes a top part, a base, and an intermediate supporting piece that connects the top part and the base; and at least two radiating arm groups conformal to the insulated support structure, and feeding mechanisms corresponding to the radiating arm groups, where +/−45 orthogonal polarization is formed between the radiating arm groups or between two radiating arms included in the radiating arm group; the feeding mechanism includes a balun and a feeding plate, where a plane on which the balun is located is parallel to a plane on which the feeding plate is located, one end of the balun is electrically connected to a corresponding radiating arm group, and another end of the balun is electrically connected to a ground layer; and the feeding plate is connected to an electric lead on the base of the insulated support structure.

In the foregoing solution, the radiating arm groups and the feeding mechanisms are conformal to a surface of the insulated support structure, and the insulated support structure is integrated as a whole. This implements integration of the dual-polarized radiating element, and also ensures that a shape of the radiating arms approximates an optimal electrical shape to a maximum extent. On one hand, this resolves problems of a long assembly time of a formed antenna and poor precision that are caused because an existing radiating element has many components and has a complex structure. On the other hand, on the insulated support structure that is integrated as a whole, connection between the balun conformal to the insulated support structure and the insulated support structure does not require welding. This resolves a prior-art problem that a welding joint affects PIM of an antenna.

In a possible design, the dual-polarized radiating element includes two radiating arm groups and two feeding mechanisms; the top part of the insulated support structure is a first plane, and the intermediate supporting piece is two vertical planes that intersect with each other; the two radiating arm groups are conformal to a surface of the first plane, each radiating arm group includes two radiating arms, +45 orthogonal polarization is formed between the two radiating arms in one of the two groups, −45 orthogonal polarization is formed between the two radiating arms in the other group, a head end and a tail end of the radiating arm form an equivalent center line, and an included angle between equivalent center lines obtained by two radiating arms in a same radiating arm group is 180 degrees; and the two feeding mechanisms are respectively located beneath the two radiating arm groups, each feeding mechanism includes a balun and a feeding plate that are conformal to opposite surfaces of the vertical plane, one end that is of the balun and that is along a protrusion of the vertical plane is electrically connected to a corresponding radiating arm group, and another end of the balun is electrically connected to the ground layer.

In the foregoing solution, the radiating arms and the feeding mechanisms corresponding to the radiating arms in the dual-polarized radiating element are conformal to the insulated support structure, and are connected to a feeding network by using a conductive connecting piece that is integrated into the insulated support structure as a whole. The components of the dual-polarized radiating element are integrated while a relatively preferable electrical shape is ensured. This resolves problems of a long assembly time of a formed antenna and poor precision that are caused because an existing radiating element has many components and has a complex structure. In addition, on the insulated support structure that is integrated as a whole, connection between the balun conformal to the insulated support structure and the insulated support structure does not require welding. This resolves a prior-art problem that a welding joint affects PIM of an antenna.

In a possible design, the dual-polarized radiating element further includes a metal layer disposed on a side that is of the first plane and that is reverse to the two radiating arm groups, where the balun is electrically connected to the corresponding radiating arm group by using the metal layer.

In the foregoing solution, the balun is electrically connected to the corresponding radiating arm group by using the metal layer. This can reduce connecting components of the radiating element, thereby shortening an antenna assembly time.

In a possible design, the two vertical planes that intersect with each other are a first vertical plane and a second vertical plane; a rabbet is provided on each of the first vertical plane and the second vertical plane, and the first vertical plane and the second vertical plane are rabbeted by using the rabbets to form an intersected structure; as for the balun that is located on the first vertical plane and that is divided into two portions, each portion is electrically connected, along an apex of a protrusion on the first vertical plane, to a corresponding radiating arm group through a first through-hole; as for the feeding plate that is located on the first vertical plane and that is divided into a long portion and a short portion, the long portion of the feeding plate is extended to an upper surface of the base; as for the balun that is located on the second vertical plane and that is divided into two portions, each portion is electrically connected, along an apex of a protrusion on the second vertical plane, to a corresponding radiating arm group through a first through-hole; as for the feeding plate that is located on the second vertical plane and that is divided into a long portion and a short portion, the long portion is extended to the upper surface of the base; and a side that is of the first vertical plane and to which the long portion of the feeding plate is conformal is adjacent to a side that is of the second vertical plane and to which the long portion of the feeding plate is conformal.

In a possible design, the first through-hole is provided on each of radiating arms in a same group at an end at which the radiating arms approximate each other.

In a possible design, the dual-polarized radiating element includes four radiating arm groups and four feeding mechanisms; the top part of the insulated support structure is a second plane, a central position of the second plane is a hollow, and edges of the hollow at the central position form an octagon; the intermediate supporting piece of the insulated support structure is an eight-ridge frustum, edges of an upper base of the eight-ridge frustum and the edges of the hollow at the central position are integrated as a whole, edges of a lower base of the eight-ridge frustum and a bottom part of the insulated support structure are integrated as a whole, and a diameter of the upper base is greater than a diameter of the lower base; the four radiating arm groups are conformal to a lower surface of the second plane, each radiating arm group includes two radiating arms, +45 orthogonal polarization is formed between two adjacent radiating arm groups, −45 orthogonal polarization is formed between the other two adjacent radiating arm groups, a head end and a tail end of the radiating arm form an equivalent center line, and an included angle between equivalent center lines obtained by two radiating arms in a same radiating arm group is 90 degrees; and the four feeding mechanisms are respectively located on corresponding frustum faces beneath the four radiating arm groups, each feeding mechanism includes a balun and a feeding plate that are conformal to an inner side and an outer side of the frustum face, the feeding plate is conformal to an inner surface of the frustum face, the balun is conformal to an outer surface of the frustum face, one end of the balun is electrically connected to a corresponding radiating arm group, and another end of the balun is electrically connected to the ground layer.

In the foregoing solution, an insulating material is used as the support structure, the radiating arm groups and the feeding mechanisms are conformal to a surface, and the insulated support structure is integrated as a whole. This implements integration of the dual-polarized radiating element, and also ensures that a shape of the radiating arms approximates an optimal electrical shape to a maximum extent. On one hand, this resolves problems of a long assembly time of a formed antenna and poor precision that are caused because an existing radiating element has many components and has a complex structure. On the other hand, on the insulated support structure that is integrated as a whole, connection between the balun conformal to the insulated support structure and the insulated support structure does not require welding. This resolves a prior-art problem that a welding joint affects the PIM of an antenna.

In a possible design, in the radiating arm groups between which +45 orthogonal polarization is formed and the radiating arm groups between which −45 orthogonal polarization is formed, one extended metal arm perpendicular to the base of the insulated support structure is disposed on a tail end of each of two adjacent radiating arms.

In a possible design, when a value of an aperture encircled by the four radiating arm groups is greater than or equal to a preset value, the extended metal arm and the corresponding radiating arm are located on a same plane.

In a possible design, a signal strip line corresponding to the feeding plate is disposed on the upper surface of the base, and the ground layer and a conductive connecting piece are disposed on a reverse side of the base; and one end of the signal strip line and one end of the corresponding feeding plate are electrically connected at a position at which the base and the vertical plane intersect, and the other end of the signal strip line is electrically connected to the ground layer by using the conductive connecting piece.

In the foregoing solution, the conductive connecting piece may be electrically connected to a signal strip line in a feeding network. This reduces welding joints for connecting the radiating element and a coaxial cable in the feeding network.

In a possible design, a signal strip line feeding network is disposed on an upper surface of the base, the ground layer and a conductive connecting piece are disposed on a reverse side of the base, and the signal strip line feeding network includes two one-to-two power splitters; and two output ends of each one-to-two power splitter are respectively connected to two corresponding feeding plates, and an input end of the one-to-two power splitter is electrically connected to the ground layer by using the conductive connecting piece.

In the foregoing solution, the conductive connecting piece is electrically connected to a signal strip line in a feeding network. This reduces welding joints for connecting the radiating element and a coaxial cable in the feeding network.

In a possible design, a second through-hole and a conductive connecting piece are disposed on the base, the base is fastened to the ground layer by using the second through-hole and the fastening piece, and the ground layer includes a reflection panel or a suspended strip line feeding network.

In the foregoing solution, the conductive connecting piece is electrically connected to a signal strip line in a feeding network. This reduces welding joints for connecting the radiating element and a coaxial cable in the feeding network.

In a possible design, the ground layer is the suspended strip line feeding network, the suspended strip line feeding network includes a cavity and a signal line that is suspended in the cavity, and a third through-hole is provided on a side of the cavity and the signal line; correspondingly, the conductive connecting piece is a probe-type conductive connecting piece; and the probe-type conductive connecting piece is electrically connected to the signal line through the third through-holes on the cavity and the signal line.

In the foregoing solution, the conductive connecting piece is electrically connected to a signal line in a feeding network. This reduces welding joints for connecting the radiating element and a coaxial cable in the feeding network.

In a possible design, the ground layer is the suspended strip line feeding network, the suspended strip line feeding network includes a cavity and a signal line that is suspended in the cavity, and a fourth through-hole is provided on a side of the cavity; and correspondingly, the conductive connecting piece is electrically coupled and connected to the signal line through the fourth through-hole, and the conductive connecting piece is a mushroom-shaped conductive connecting piece or a probe-type conductive connecting piece.

In the foregoing solution, the conductive connecting piece is electrically coupled and connected to a signal line in a feeding network. This reduces welding joints for connecting the radiating element and a coaxial cable in the feeding network.

In a possible design, the feeding plate is L-shaped.

In a possible design, the base is further provided with an elastic mechanical part for fastening the base.

In the foregoing solution, the elastic mechanical part may be configured to fasten a performance debugging component of the radiating element.

In a possible design, the dual-polarized radiating element further includes a metal mechanical part that is integrated into the insulated support structure as a whole and that is located above the insulated support structure, where the metal mechanical part is configured to perform electrical performance debugging on the dual-polarized radiating element.

According to a second aspect, an embodiment of this application discloses an antenna, where the antenna has an independent array including the dual-polarized radiating element according to any possible design of the first aspect.

According to a third aspect, an embodiment of this application discloses a base station, where the base station includes the antenna disclosed in the second aspect.

According to a fourth aspect, an embodiment of this application discloses a communications system, where the communications system includes the base station disclosed in the third aspect.

BRIEF DESCRIPTION OF THE DRAWINGS

To describe the technical solutions in this application more clearly, the following briefly describes the accompanying drawings required for describing this application or the prior art. Apparently, the accompanying drawings in the following description are merely some examples of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in this application with reference to the accompanying drawings in specific embodiments of this application. Apparently, the described embodiments are only some but not all of the examples of this application. All other examples obtained by a person of ordinary skill in the art based on the embodiments of this application without creative efforts shall fall within the protection scope of this application.

It can be learned from the BACKGROUND section that, currently, when a wireless network is deployed, problems that it is difficult to obtain a site for a new base station and a bearing capability of a single base station is limited are considered. A radiating element in an existing antenna has many components, and welding is performed during cable layout in an antenna assembly process. Quality of a welding joint directly affects PIM of the antenna. In addition, the welding joint suffers an aging effect, and the quality of the welding joint degrades with time. This affects the PIM of the antenna and shortens a lifecycle of the antenna. Therefore, a prior-art radiating element can hardly meet a requirement of a new antenna on a new base station.

An embodiment of this application discloses a dual-polarized radiating element. The dual-polarized radiating element is applied to an antenna. In this embodiment of this application, the antenna is a base station antenna. However, application of the dual-polarized radiating element in this embodiment of this application is not limited to the base station antenna.

Polarization of the base station antenna is defined by using the dual-polarized radiating element disclosed in this embodiment of this application.

The ground is used as a horizontal plane, the base station antenna is placed vertically on the horizontal plane, and a propagation direction of an electromagnetic wave is used as a direction of a sight line. Then, the polarization of the base station antenna is defined as horizontal, vertical, or +/−45 polarization by using an included angle between a linear polarization unit and the ground. In this embodiment of this application, an included angle between the dual-polarized radiating element and the ground is defined as +/−45 polarization.

Figure 1:
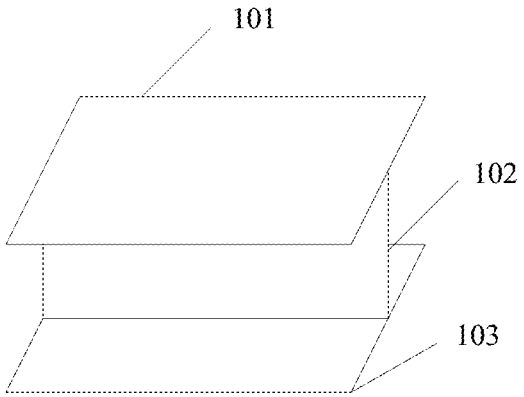
FIG. 1 is a simple diagram of a dual-polarized radiating element disclosed in an embodiment of this application.

FIG. 1 is a simple diagram of a dual-polarized radiating element disclosed in an embodiment of this application. The dual-polarized radiating element includes: an insulated support structure that is integrated as a whole, where the insulated support structure is a solid structure.

The insulated support structure includes a top part 101, a base 103, and an intermediate supporting piece 102 that connects the top part 101 and the base 103.

At least two radiating arm groups and feeding mechanisms corresponding to the radiating arm groups are conformal to the insulated support structure.

In a specific application instance, conformation is described by using an example. For example, an object A has two surfaces, and a carrier B is used to carry the object A. A surface of the object A is in contact with a surface of the carrier B and is completely fit into the surface of the carrier B. Usually, the other surface of the object A is also approximately fit into this surface of the carrier B. Therefore, when it cannot be recognized whether the object A and the carrier B, when viewed from afar, are two objects, the relationship between the object A and the carrier B is called conformation.

The radiating arm groups each include two radiating arms, and +/−45 orthogonal polarization is formed between the two radiating arms.

Alternatively, +/−45 orthogonal polarization is formed between the radiating arm groups.

In a specific application instance, radiating arms in a same group have same or similar shapes or structures.

The feeding mechanism includes a balun and a feeding plate. A plane on which the balun is located is parallel to a plane on which the feeding plate is located.

One end of the balun is electrically connected to a corresponding radiating arm group, and another end of the balun is electrically connected to a ground layer.

The feeding plate is connected to an electric lead on the base of the insulated support structure.

In this embodiment of this application, the balun is a balanced to unbalanced transformer (balun). An antenna port usually requires balanced excitation, but a common transmission line usually provides unbalanced transmission. Therefore, when the common transmission line is used to excite an antenna, the balun needs to be added to perform transformation.

In a specific application instance, the insulated support structure 10 to which the radiating arm groups 11 and the feeding mechanisms 12 are conformal may be integrated as a whole by using a mold or by printing. This ensures that a shape of the radiating arms in the radiating arm groups 11 approximates an optimal electrical shape to a maximum extent.

In this embodiment of this application, the radiating arm groups and the feeding mechanisms are conformal to a surface of the insulated support structure, and the insulated support structure is integrated as a whole. This implements integration of the dual-polarized radiating element, and also ensures that a shape of the radiating arms approximates an optimal electrical shape to a maximum extent. On one hand, this resolves problems of a long assembly time of a formed antenna and poor precision that are caused because an existing radiating element has many components and has a complex structure. On the other hand, on the insulated support structure that is integrated as a whole, connection between the balun conformal to the insulated support structure and the insulated support structure does not require welding. This resolves a prior-art problem that a welding joint affects PIM of an antenna.

Based on the dual-polarized radiating element disclosed in this embodiment of this application, this application provides further detailed descriptions by using the following examples.

Example 1

Figure 2:
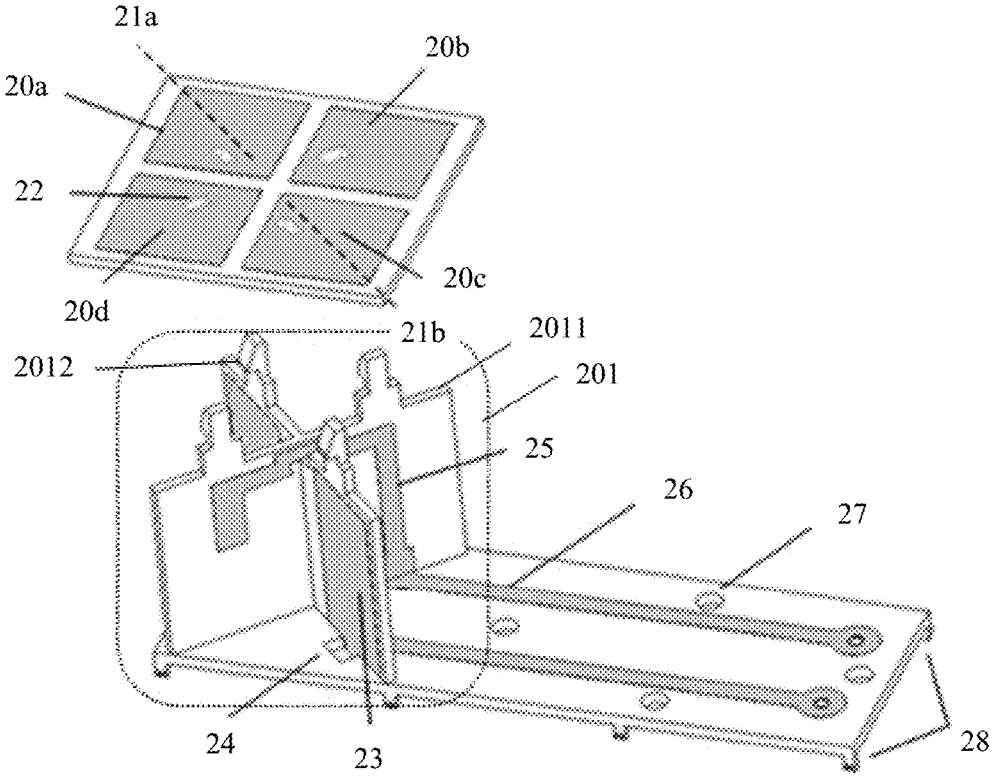
FIG. 2 is a schematic structural diagram of a dual-polarized radiating element disclosed in an embodiment of this application.

FIG. 2 is a schematic structural diagram of a dual-polarized radiating element 2 disclosed in an embodiment of this application.

The dual-polarized radiating element 2 includes an insulated support structure that is integrated as a whole, and two radiating arm groups and two feeding mechanisms that are conformal to a surface of the insulated support structure.

To describe a structure of each part in the insulated support structure that is integrated as a whole, FIG. 2 displays the parts by using an exploded diagram. Actually, the insulated support structure is integrated.

As shown in FIG. 2, the insulated support structure includes a top part, an intermediate supporting piece 201, and a base.

The top part is a first plane, and the two radiating arm groups are conformal to a surface of the first plane. One radiating arm group includes two radiating arms.

As shown in FIG. 2, in this embodiment of this application, the two radiating arm groups include four radiating arms in total: a radiating arm 20*a*, a radiating arm 20*b*, a radiating arm 20*c*, and a radiating arm 20*d*.

The radiating arm 20*a* and the radiating arm 20*c* are located in a first radiating arm group, and +45 orthogonal polarization is formed between the radiating arm 20*a* and the radiating arm 20*c*. The radiating arm 20*b* and the radiating arm 20*d* are located in a second radiating arm group, and −45 orthogonal polarization is formed between the radiating arm 20*b* and the radiating arm 20*d*.

A head end and a tail end of each of the radiating arm 20*a*, the radiating arm 20*b*, the radiating arm 20*c*, and the radiating arm 20*d* form an equivalent center line. In addition, an included angle between equivalent center lines obtained by two radiating arms in a same radiating arm group is 180 degrees.

Equivalent center lines of the radiating arm 20*a* and the radiating arm 20*c* that are located in the first radiating arm group in FIG. 2 are used as an example: an included angle between an equivalent center line 21*a* of the radiating arm 20*a* and an equivalent center line 21*c* of the radiating arm 20*c* is 180 degrees, and the equivalent center lines form an approximate straight line.

Likewise, an included angle between equivalent center lines of the radiating arm 20*b* and the radiating arm 20*d* in the second radiating arm group is 180 degrees, and the equivalent center lines also form an approximate straight line.

It should be noted that a manner of implementing +45 polarization and a manner of implementing −45 polarization are similar, and may be cross-referenced. Equivalent center lines of the two radiating arm groups are also approximately orthogonal.

In a specific implementation process, radiating arms located in a same radiating arm group disclosed in this embodiment of this application have a same shape and size.

The two feeding mechanisms are respectively located beneath the two radiating arm groups, and each feeding mechanism includes a balun and a feeding plate that are conformal to opposite surfaces of a vertical plane. One end that is of the balun and that is along a protrusion of the vertical plane is electrically connected to a corresponding radiating arm group, and another end of the balun is electrically connected to a ground layer.

As shown in FIG. 2, specifically, the intermediate supporting piece 201 is two vertical planes that intersect with each other. As shown in FIG. 2, the two vertical planes that intersect with each other include a first vertical plane 2011 and a second vertical plane 2012.

A rabbet is provided on each of the first vertical plane 2011 and the second vertical plane 2012, and the first vertical plane 2011 and the second vertical plane 2012 are rabbeted by using the rabbets to form an intersected structure.

FIG. 2 shows a balun 23 in a feeding mechanism located beneath the first radiating arm group, and the balun 23 is located on the first vertical plane 2011. The balun 23 is divided into two portions because of the intersected structure of the first vertical plane 2011 and the second vertical plane 2012. Each portion of the balun 23 is electrically connected, along an apex of a protrusion on the first vertical plane 2011, to the radiating arm 20*a* and the radiating arm 20*c* in the corresponding first radiating arm group through a first through-hole 22.

In this embodiment of this application, the first through-hole 22 is provided at an end at which two radiating arms in a same radiating arm group approximate each other. As shown in FIG. 2, the first through-hole 22 located on each of the radiating arm 20*a*, the radiating arm 20*b*, the radiating arm 20*c*, and the radiating arm 20*d* is close to an end at which radiating arms in a same group approximate each other.

A feeding plate that is located in the same feeding mechanism as the balun 23 is located on another side of the first vertical plane 2011. Similarly, the feeding plate is divided into a long portion and a short portion, and portions in a direction along the vertical plane are approximately parallel. The long portion of the feeding plate is extended to an upper surface of the base.

Likewise, the other feeding mechanism is located beneath the second radiating arm group. A balun in the feeding mechanism is located on the second vertical plane 2012, and is divided into two portions because of the intersected structure of the first vertical plane 2011 and the second vertical plane 2012. Each portion of the balun is electrically connected, along an apex of a protrusion on the second vertical plane 2012, to the corresponding radiating arm group through a first through-hole 22.

FIG. 2 shows a feeding plate 25 beneath the second radiating arm group. The feeding plate 25 is located on another side of the second vertical plane 2012. Similarly, the feeding plate 25 is divided into a long portion and a short portion, and portions in a direction along the vertical plane are approximately parallel. The long portion of the feeding plate 25 is extended to the upper surface of the base 203.

It should be noted that a balun and a feeding plate that are located in a same feeding mechanism are respectively conformal to two surfaces of one vertical plane, and work in a coordinated manner to form a mechanism for performing feeding balance on a corresponding radiating arm. In a specific application instance, a type of a feeding transmission line of the feeding mechanism is a microstrip line.

The microstrip is a microwave transmission line that includes a single conductor belt and a ground layer that prop against two sides of a dielectric substrate. Dielectric constants of common dielectric substrates are all obviously greater than a relative dielectric constant of air, which is 1. Therefore, for a microstrip having a shielding case, a vertical height from a conductor belt to a metal shielding case needs to be greater than a height from the conductor belt to the ground layer.

In a specific application instance, when the balun is conformal to the vertical plane, the balun may occupy a part of a surface of the vertical plane or may occupy an entire surface.

It should be noted that when the first vertical plane 2011 and the second vertical plane 2012 form an intersected structure, a side that is of the first vertical plane 2011 and to which the long portion of the feeding plate is conformal is adjacent to a side that is of the second vertical plane 2012 and to which the long portion of the feeding plate is conformal. A location relationship between a feeding plate and a balun in different groups is as follows: Projections, of two portions of the feeding plate that are approximately parallel, on a plane on which the balun is located, are located on two sides of the balun respectively.

In a specific application instance, the feeding plate may be preferably L-shaped.

Based on the dual-polarized radiating element disclosed in this embodiment of this application, a structure of the base may include a second through-hole and a conductive connecting piece. The base is fastened to the ground layer by using the second through-hole and the fastening piece. The ground layer includes a reflection panel or a suspended strip line feeding network.

The base may alternatively include a signal strip line that is corresponding to the feeding plate and that is disposed on the upper surface of the base, and the ground layer and a conductive connecting piece that are disposed on a reverse side of the base.

As an example for description, one end of a signal strip line 26 shown in FIG. 2 and one end of the corresponding feeding plate 25 are electrically connected at a position at which the base and the vertical plane intersect. The other end of the signal strip line 26 is electrically connected to the ground layer by using the conductive connecting piece.

Further, the base is further provided with a second through-hole and an elastic mechanical part for fastening the base. The second through-hole is equivalent to a rivet hole 27 shown in FIG. 2. The elastic mechanical part is equivalent to an elastic hook 28 that is disposed on an edge of the base and that is shown in FIG. 2.

Figure 3:
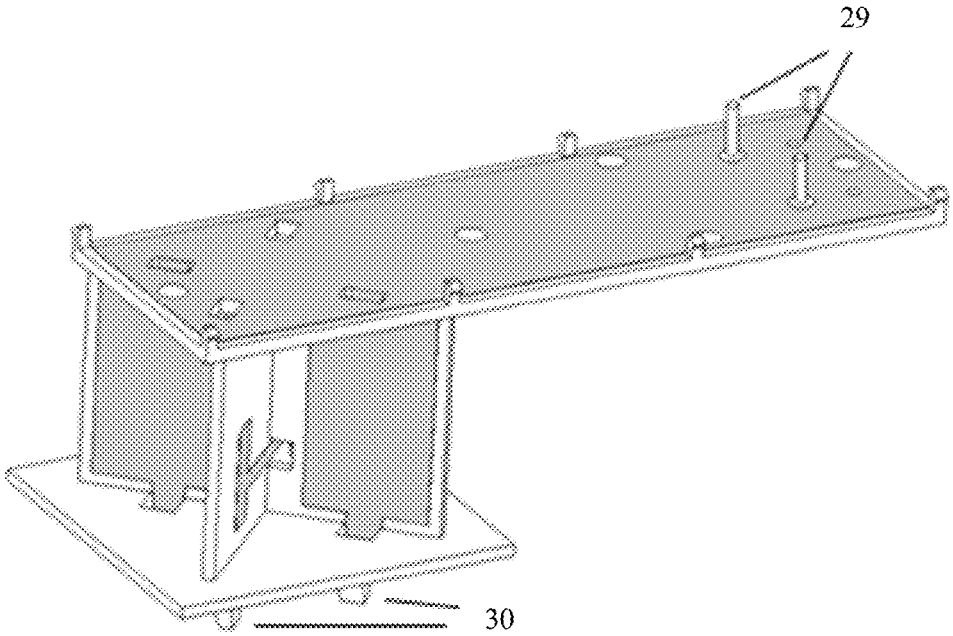
FIG. 3 is a schematic structural diagram of a dual-polarized radiating element disclosed in an embodiment of this application.

As shown in FIG. 3, the conductive connecting piece may be a probe-type connecting piece 29. In this embodiment of this application, the ground layer disposed on the reverse side of the base is a metal ground layer, and the base is provided with two probe-type connecting pieces 29. With reference to FIG. 2 and FIG. 3, the probe-type connecting pieces 29, the signal strip line 26, and the feeding plate 25 are electrically conducted.

In a specific application process, the insulated support structure that is integrated as a whole and that is disclosed in this embodiment of this application further includes a metal mechanical part that is integrated into the top part of the insulated support structure. The metal mechanical part is configured to perform electrical performance debugging on the dual-polarized radiating element. As shown in FIG. 3, the metal mechanical part is equivalent to an elastic hook 30 that is shown in FIG. 3 and that is located on the top part of the insulated support structure. In specific application, the elastic hook 30 may be a metal directing piece.

Figure 4:
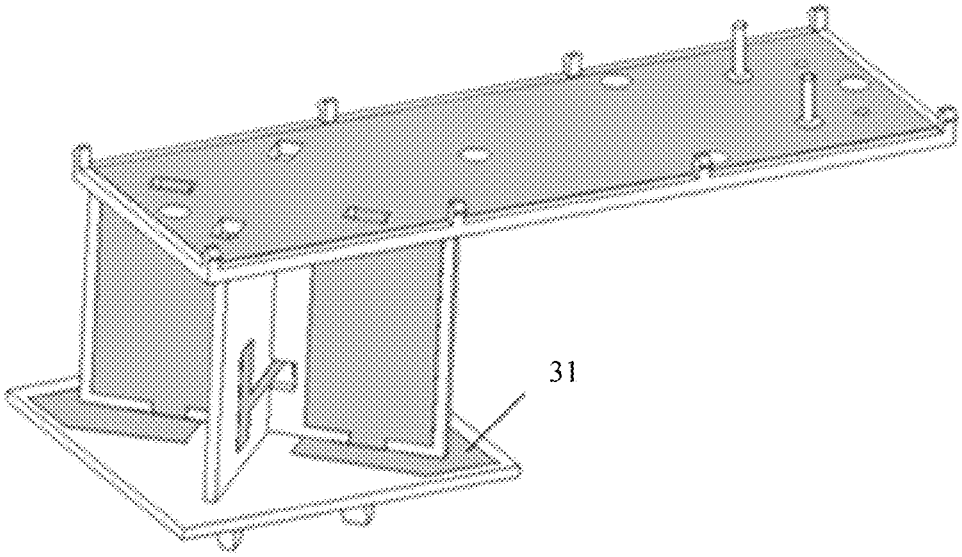
FIG. 4 is a schematic structural diagram of a dual-polarized radiating element disclosed in an embodiment of this application.

In a specific application process, the dual-polarized radiating element further includes a metal layer disposed on a side that is of the first plane and that is reverse to the two radiating arm groups. In other words, the two radiating arm groups are located on an upper surface of the first plane, and the metal layer is located on a lower surface of the first plane. A balun is electrically coupled and connected to a corresponding radiating arm group by using the metal layer. The metal layer is equivalent to a coupling metal plane 31 shown in FIG. 4.

In this embodiment of this application, related electrical connection includes direct electrical connection (or direct electrical conduction) and electrically coupled connection (or electrically coupled connection).

The direct electrical connection is as follows: Direct-current-conducted connection exists between two conductive components. For example, the components are welded, and the connection may be tested and determined by using a multimeter.

The electrically coupled connection is as follows: Radio-frequency-conducted connection exists between two conductive components. For example, the components are coupled at a short distance by using a metal plane. The connection may be tested and determined by using a vector network analyzer.

In this embodiment of this application, the radiating arms and the feeding mechanisms corresponding to the radiating arms in the dual-polarized radiating element are conformal to the insulated support structure, and are connected to a feeding network by using a conductive connecting piece that is integrated into the insulated support structure as a whole. The components of the dual-polarized radiating element are integrated while a relatively preferable electrical shape is ensured. This resolves problems of a long assembly time of a formed antenna and poor precision that are caused because an existing radiating element has many components and has a complex structure. In addition, on the insulated support structure that is integrated as a whole, connection between the balun conformal to the insulated support structure and the insulated support structure does not require welding. This resolves a prior-art problem that a welding joint affects PIM of an antenna.

Example 2

An embodiment of this application discloses a dual-polarized radiating element. The dual-polarized radiating element includes an insulated support structure that is integrated as a whole, and four radiating arm groups and four feeding mechanisms that are conformal to a surface of the insulated support structure.

Figure 5:
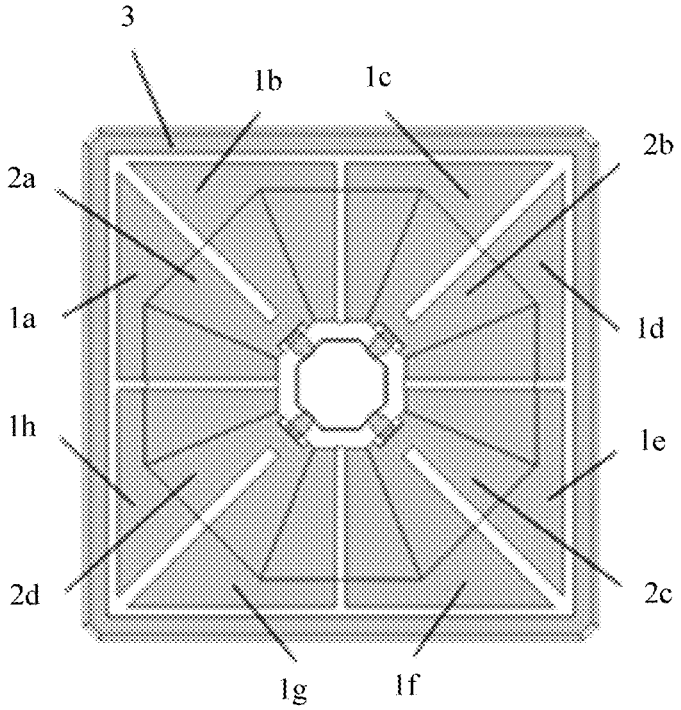
FIG. 5 is a bottom view of another dual-polarized radiating element disclosed in an embodiment of this application.
Figure 6:
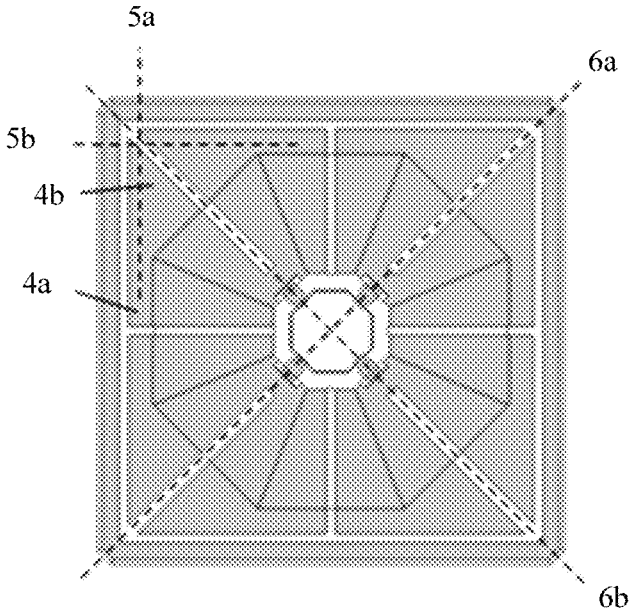
FIG. 6 is a bottom view of another dual-polarized radiating element disclosed in an embodiment of this application.

FIG. 5 and FIG. 6 are bottom views of the dual-polarized radiating element. A direction of a sight line is from an intermediate supporting piece of the insulated support structure to a top part of the insulated support structure, and FIG. 5 and FIG. 6 show an outer surface of the insulated support structure.

The top part of the insulated support structure is a second plane, a central position of the second plane is a hollow, and edges of the hollow at the central position form an octagon.

The four radiating arm groups are conformal to a lower surface of the second plane. Each radiating arm group includes two radiating arms. +45 orthogonal polarization is formed between two adjacent radiating arm groups, and −45 orthogonal polarization is formed between the other two adjacent radiating arm groups.

Specifically, as shown in FIG. 5, a radiating arm 1*a* and a radiating arm 1*b* are a first radiating arm group 2*a*, a radiating arm 1*f* and a radiating arm 1*e* are a second radiating arm group 2*c*, a radiating arm 1*c* and a radiating arm 1*d* are a third radiating arm group 2*b*, and a radiating arm 1*g* and a radiating arm 1*h* are a fourth radiating arm group 2*d*.

+45 orthogonal polarization is formed between the first radiating arm group 2*a* and the second radiating arm group 2*c*, and −45 orthogonal polarization is formed between the third radiating arm group 2*b* and the fourth radiating arm group 2*d*.

In a specific implementation process, radiating arms located in a same radiating arm group disclosed in this embodiment of this application have a same shape and size.

Same as Example 1, a head end and a tail end of a radiating arm form an equivalent center line. A difference lies in that an included angle between equivalent center lines obtained by two radiating arms in a same radiating arm group is 90 degrees.

With reference to FIG. 5 and FIG. 6, the radiating arm 1*a* and the radiating arm 1*b* in the first radiating arm group are used as an example. As shown in FIG. 6, a head end of the radiating arm 1*a* is 4*a*, a tail end of the radiating arm 1*a* is 4*b*, and the head end 4*a* and the tail end 4*b* of the radiating arm 1*a* form an equivalent center line 5*a*; and a head end and a tail end of the radiating arm 1*b* form an equivalent center line 5*b*.

As shown in FIG. 6, the two radiating arm groups between which +45 orthogonal polarization is formed are mirror-symmetric along an equivalent polarization axis of the dual-polarized radiating element, where the equivalent polarization axis is 6*a*. The two radiating arm groups between which −45 orthogonal polarization is formed are also mirror-symmetric along an equivalent polarization axis of the dual-polarized radiating element, where the equivalent polarization axis is 6*b*.

Figure 7:
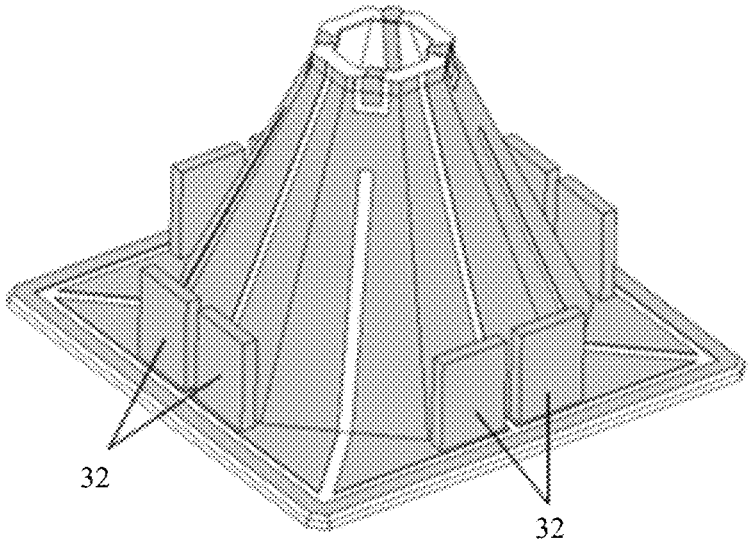
FIG. 7 is a partial schematic structural diagram of another dual-polarized radiating element disclosed in an embodiment of this application.

Based on the dual-polarized radiating element disclosed in this embodiment of this application, in a specific implementation process, in the radiating arm groups between which the +45 orthogonal polarization is formed and the radiating arm groups between which the −45 orthogonal polarization is formed, an extended metal arm, for example, an extended metal arm 32 shown in FIG. 7, perpendicular to a base of the insulated support structure is disposed on a tail end of each of two adjacent radiating arms.

Further, when a value of an aperture encircled by the four radiating arm groups is greater than or equal to a preset value, the extended metal arm 32 and the corresponding radiating arm are located on a same plane.

Figure 8:
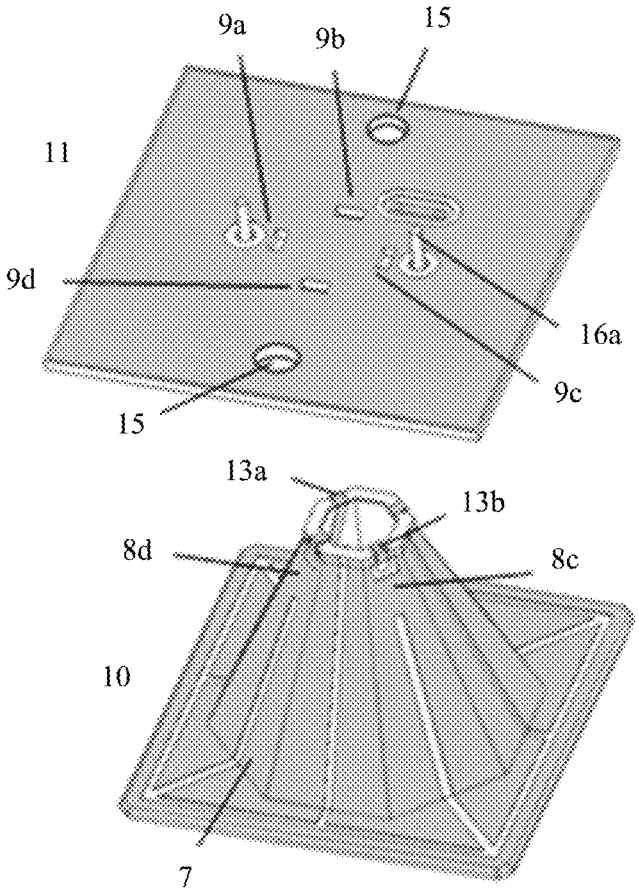
FIG. 8 is a schematic structural diagram of another dual-polarized radiating element disclosed in an embodiment of this application.

As shown in FIG. 8, the intermediate supporting piece of the insulated support structure is an eight-ridge frustum, and edges of an upper base of the eight-ridge frustum and the edges of the hollow at the central position are integrated as a whole. Edges of a lower base of the eight-ridge frustum and a bottom part 11 of the insulated support structure are integrated as a whole, and a diameter of the upper base is greater than a diameter of the lower base.

The four feeding mechanisms are respectively located on corresponding frustum faces beneath the four radiating arm groups. Each feeding mechanism includes a balun and a feeding plate that are conformal to an inner side and an outer side of the frustum face.

The feeding plate is conformal to an inner surface of the frustum face. The balun is conformal to an outer surface of the frustum face. One end (an apex 7) of the balun is electrically connected to a corresponding radiating arm group, and another end (a bottom part 8*d*) of the balun is electrically connected to a ground layer.

In a specific application instance, as shown in FIG. 8, the bottom part 8*d* of the balun is electrically connected to the ground layer of the base 11 through a through-hole 9*d*. In FIG. 8, a through-hole 9*a*, a through-hole 9*b*, and a through-hole 9*c* have a same function as the through-hole 9*d*, so that bottom parts of the other three baluns may be electrically connected to the ground layer of the base 11 through the corresponding through-holes. For example, a bottom part 8*c* of another balun shown in FIG. 8 is electrically connected to the ground layer of the base 11 through the corresponding through-hole 9*c*.

Figure 9:
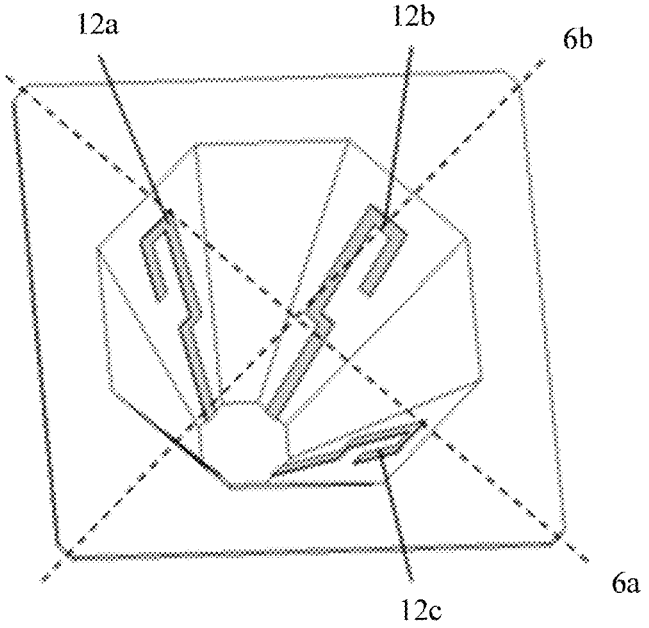
FIG. 9 is a partial schematic structural diagram of another dual-polarized radiating element disclosed in an embodiment of this application.

FIG. 9 is a solid front view of the insulated support structure. FIG. 9 shows a feeding plate 12*a*, a feeding plate 12*b*, and a feeding plate 12*c*. The feeding plate 12*a* and the feeding plate 12*c* are mirror-symmetric along the equivalent polarization axis 6*a*. The feeding plate 12*b* and another feeding plate that is not shown are mirror-symmetric along the equivalent polarization axis 6*b*.

In a specific application instance, when the balun is conformal to an outer surface of the eight-ridge frustum, the balun may occupy a part of the surface or may occupy the entire surface.

It should be noted that a location relationship between a feeding plate and a balun in different groups is the same as the location relationship in Example 1. Refer to descriptions in Example 1. Details are not described herein again.

In a specific application instance, the feeding plates illustrated in this embodiment of this application may be L-shaped.

Based on the dual-polarized radiating element disclosed in this embodiment of this application, a structure of the base may include: a second through-hole and a conductive connecting piece, where the base is fastened to the ground layer by using the second through-hole and the fastening piece, and the ground layer includes a reflection panel or a suspended strip line feeding network.

The base may alternatively include a signal strip line that is corresponding to the feeding plate and that is disposed on an upper surface of the base, and the ground layer and a conductive connecting piece that are disposed on a reverse side of the base.

Further, the base is further provided with a second through-hole, and the second through-hole is equivalent to a through-hole 15 shown in FIG. 8. The through-hole 15 may be a rivet hole, and may be used to fasten the base in coordination with a rivet.

Figure 10:
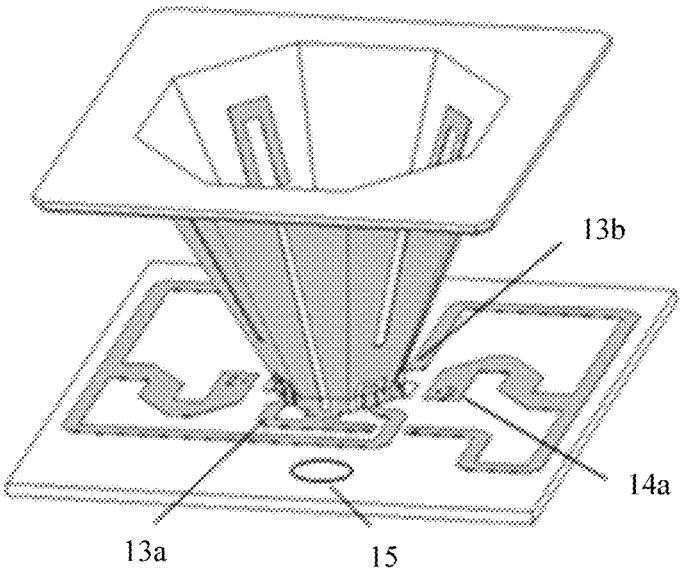
FIG. 10 is a solid front view of another dual-polarized radiating element disclosed in an embodiment of this application.

The base may alternatively include a signal strip line feeding network disposed on an upper surface of the base, and the ground layer and a conductive connecting piece that are disposed on a reverse side of the base. FIG. 10 is a solid front view of the dual-polarized radiating element. The signal strip line feeding network includes two one-to-two power splitters. Two output ends of each one-to-two power splitter are respectively connected to two corresponding feeding plates, and an input end of the one-to-two power splitter is electrically connected to the ground layer by using the conductive connecting piece.

Using L-shaped feeding plates in a same group shown in FIG. 10 as an example, the L-shaped feeding plates in the same group are connected to a one-to-two power splitter at 13*a* and 13*b*. An output end 14*a* of the one-to-two power splitter is electrically connected to the conductive connecting piece on the reverse side of the base.

Figure 11:
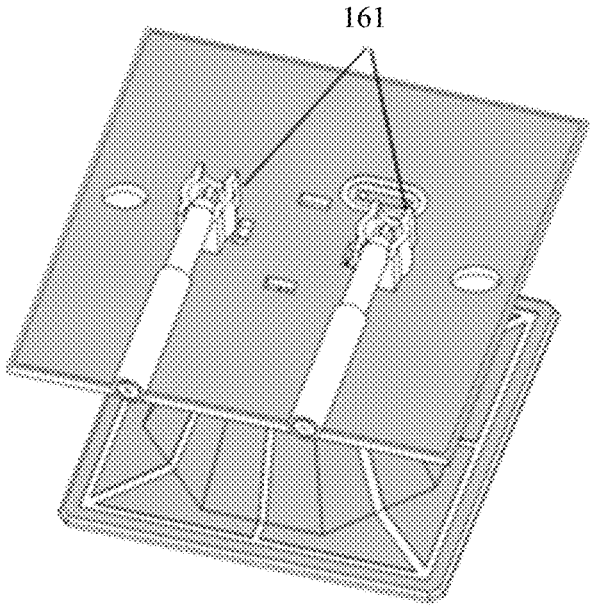
FIG. 11 is a schematic structural diagram of a conductive connecting piece disclosed in an embodiment of this application.

Further, as shown in FIG. 11, two output ends of a one-to-two power splitter are connected to probe-type conductive connecting pieces 161 disposed on the base. A groove is provided on a tail end of the probe-type conductive connecting piece 161, and may be used to bear and weld an inner core of a coaxial cable. Correspondingly, the reverse side of the base is provided with a holder that has a groove. The holder is used to bear and weld an external conductor of the coaxial cable, and is electrically conducted with the ground layer at a bottom part, thereby connecting the base and the feeding network.

Based on the ground layer disclosed in this embodiment of this application, in Example 2, the ground layer may be a suspended strip line feeding network.

Figure 12:
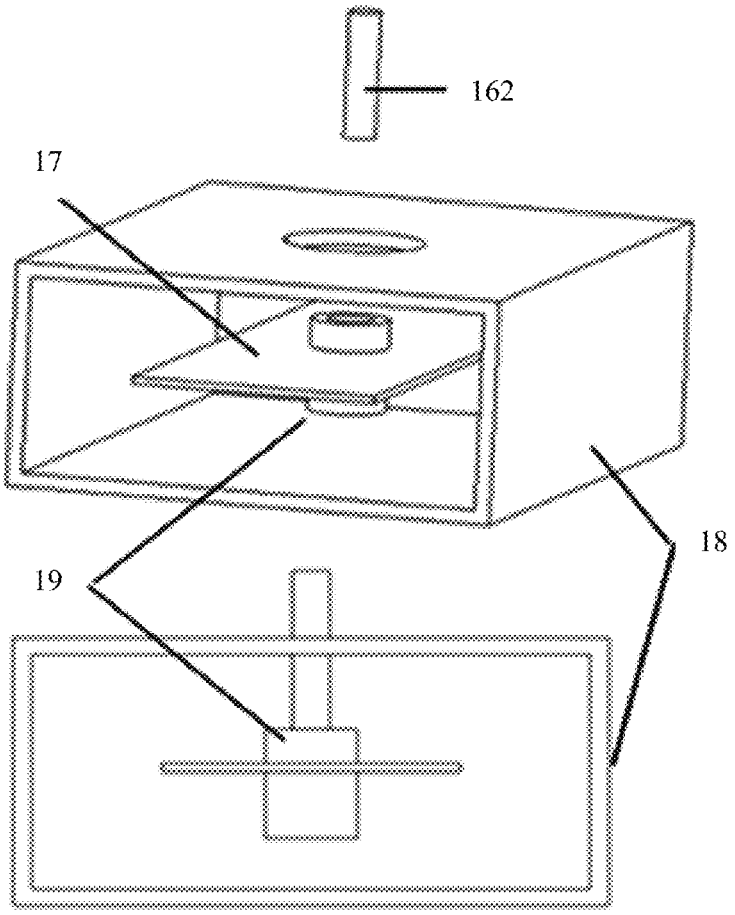
FIG. 12 is a schematic structural diagram of a feeding network and a conductive connecting piece disclosed in an embodiment of this application.

As shown in FIG. 12, a suspended strip line feeding network includes a cavity 18 and a signal line 17 that is suspended in the cavity 18. A coupling sleeve 19 is provided at a central position of the signal line 17. The signal line 17 and the coupling sleeve 19 are integrated as a whole. A third through-hole is provided on a side of the cavity.

A probe-type conductive connecting piece 162 penetrates through the third through-hole on the cavity 18, and is electrically coupled and connected to the coupling sleeve 19 on the signal line 17.

Figure 13:
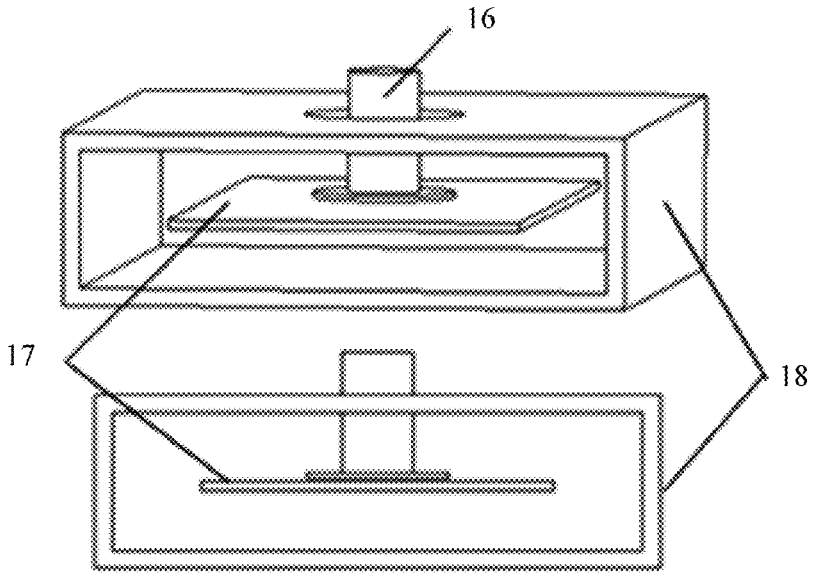
FIG. 13 is a schematic structural diagram of another feeding network and another conductive connecting piece disclosed in an embodiment of this application.

As shown in FIG. 13, a suspended strip line feeding network includes a cavity 18 and a signal line 17 that is suspended in the cavity 18. A fourth through-hole is provided on a side of the cavity 18.

The conductive connecting piece is electrically coupled and connected to the signal line 17 through the fourth through-hole.

Figure 14:
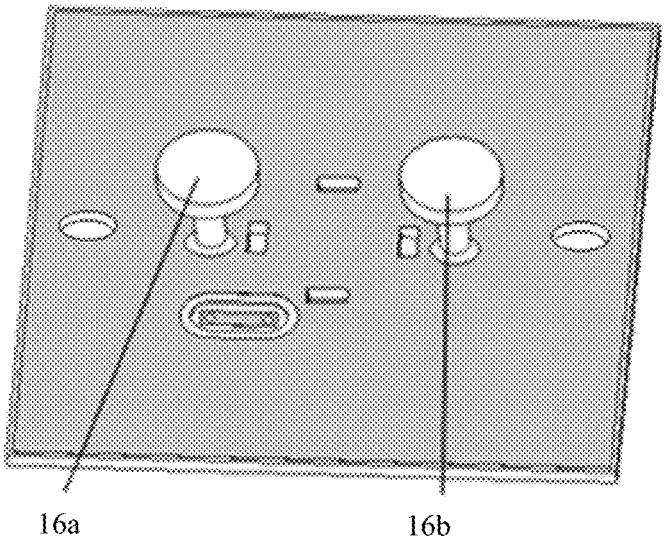
FIG. 14 is a schematic structural diagram of a conductive connecting piece disclosed in an embodiment of this application.

As shown in FIG. 14, the conductive connecting piece is mushroom-shaped conductive connecting pieces 16*a* and 16*b*, or may be a probe-type conductive connecting piece.

In this embodiment of this application, an insulating material is used as the support structure, the radiating arm groups and the feeding mechanisms are conformal to a surface, and the insulated support structure is integrated as a whole. This implements integration of the dual-polarized radiating element, and also ensures that a shape of the radiating arms approximates an optimal electrical shape to a maximum extent. On one hand, this resolves problems of a long assembly time of a formed antenna and poor precision that are caused because an existing radiating element has many components and has a complex structure. On the other hand, on the insulated support structure that is integrated as a whole, connection between the balun conformal to the insulated support structure and the insulated support structure does not require welding. This resolves a prior-art problem that a welding joint affects PIM of an antenna.

Based on the dual-polarized radiating element disclosed in the foregoing embodiments of this application, correspondingly, this application further discloses a base station antenna that is constructed by using the dual-polarized radiating element, and a communications system that has the base station antenna.

It should be noted that application of the dual-polarized radiating element is not limited to the base station antenna.

The foregoing descriptions are merely preferable embodiments of this application, and are not intended to limit this application. For a person skilled in the art, this application may have various modifications and variations. Any modification, equivalent replacement, or improvement made without departing from the spirit and principle of this application shall fall within the protection scope of this application.

What is claimed is:

1. A dual-polarized radiating element of an antenna comprising:

an insulated support structure comprising a top part, a base, and an intermediate supporting piece that connects the top part and the base, the insulated support structure being a solid structure; and at least two radiating arm groups conformal to the insulated support structure, and feeding mechanisms corresponding to the radiating arm groups, wherein +/−45 orthogonal polarization is formed between the radiating arm groups or between two radiating arms comprised in each of the radiating arm groups;

the feeding mechanism comprises a balun and a feeding plate, wherein a plane on which the balun is located is parallel to a plane on which the feeding plate is located, one end of the balun is electrically coupled to a corresponding radiating arm group, and another end of the balun is electrically coupled to a ground layer; and the feeding plate is coupled to an electric lead on the base of the insulated support structure.

2. The dual-polarized radiating element according to claim 1, further comprising two radiating arm groups and two feeding mechanisms, wherein the top part of the insulated support structure is a first plane, and the intermediate supporting piece is two vertical planes that intersect with each other;

the two radiating arm groups are conformal to a surface of the first plane, each radiating arm group comprises two radiating arms, +45 orthogonal polarization is formed between the two radiating arms in one of the two groups, −45 orthogonal polarization is formed between the two radiating arms in the other group, a head end and a tail end of the radiating arm form an equivalent center line, and an included angle between equivalent center lines corresponding to the two radiating arms in each radiating arm group is 180 degrees; and the two feeding mechanisms are respectively located beneath the two radiating arm groups, each feeding mechanism comprising a balun and a feeding plate that are conformal to opposite surfaces of the vertical plane, one end that is of the balun and that is along a protrusion of the vertical plane is electrically coupled to a corresponding radiating arm group, and another end of the balun is electrically coupled to the ground layer.

3. The dual-polarized radiating element according to claim 2, further comprising a metal layer disposed on a side that is of the first plane and that is reverse to the two radiating arm groups, wherein the balun is electrically coupled to the corresponding radiating arm group by using the metal layer.

4. The dual-polarized radiating element according to claim 2, wherein the two vertical planes that intersect with each other are a first vertical plane and a second vertical plane;

a rabbet is provided on each of the first vertical plane and the second vertical plane, and the first vertical plane and the second vertical plane are rabbeted by using the rabbets to form an intersected structure;

as for the balun that is located on the first vertical plane and that is divided into two portions, each portion is electrically coupled, along an apex of a protrusion on the first vertical plane, to a corresponding radiating arm group through a first through-hole;

as for a feeding plate that is located on the first vertical plane and that is divided into a long portion and a short portion, the long portion of the feeding plate is extended to an upper surface of the base;

as for the balun that is located on the second vertical plane and that is divided into two portions, each portion is electrically coupled, along an apex of a protrusion on the second vertical plane, to a corresponding radiating arm group through a first through-hole;

as for the feeding plate that is located on the second vertical plane and that is divided into a long portion and a short portion, the long portion is extended to the upper surface of the base; and a side that is of the first vertical plane and to which the long portion of the feeding plate is conformal is adjacent to a side that is of the second vertical plane and to which the long portion of the feeding plate is conformal.

5. The dual-polarized radiating element according to claim 4, wherein the first through-hole is provided on each of radiating arms in a same group at an end at which the radiating arms approximate each other.

6. The dual-polarized radiating element according to claim 1, comprising four radiating arm groups and four feeding mechanisms, wherein the top part of the insulated support structure is a second plane, a central position of the second plane is a hollow, and edges of the hollow at the central position form an octagon;

the intermediate supporting piece of the insulated support structure is an eight-ridge frustum, edges of an upper base of the eight-ridge frustum and the edges of the hollow at the central position are integrated as a whole, edges of a lower base of the eight-ridge frustum and a bottom part of the insulated support structure are integrated as a whole, and a diameter of the upper base is greater than a diameter of the lower base;

the four radiating arm groups are conformal to a lower surface of the second plane, each radiating arm group comprises two radiating arms, +45 orthogonal polarization is formed between two adjacent radiating arm groups, −45 orthogonal polarization is formed between the other two adjacent radiating arm groups, a head end and a tail end of the radiating arm form an equivalent center line, and an included angle between equivalent center lines obtained by two radiating arms in a same radiating arm group is 90 degrees; and the four feeding mechanisms are respectively located on corresponding frustum faces beneath the four radiating arm groups, each feeding mechanism comprising a balun and a feeding plate that are conformal to an inner side and an outer side of the frustum face, the feeding plate is conformal to an inner surface of the frustum face, the balun is conformal to an outer surface of the frustum face, one end of the balun is electrically coupled to a corresponding radiating arm group, and another end of the balun is electrically coupled to the ground layer.

7. The dual-polarized radiating element according to claim 6, wherein in the radiating arm groups between which +45 orthogonal polarization is formed and the radiating arm groups between which −45 orthogonal polarization is formed, one extended metal arm perpendicular to the base of the insulated support structure is disposed on a tail end of each of two adjacent radiating arms.

8. The dual-polarized radiating element according to claim 7, wherein when a value of an aperture encircled by the four radiating arm groups is greater than or equal to a preset value, the extended metal arm and the corresponding radiating arm are located on a same plane.

9. The dual-polarized radiating element according to claim 1, wherein a signal strip line corresponding to the feeding plate is disposed on an upper surface of the base, and the ground layer and a conductive connecting piece are disposed on a reverse side of the base; and one end of the signal strip line and one end of the corresponding feeding plate are electrically coupled at a position at which the base and a vertical plane intersect, and the other end of the signal strip line is electrically coupled to the ground layer by using the conductive connecting piece.

10. The dual-polarized radiating element according to claim 1, wherein a signal strip line feeding network is disposed on an upper surface of the base, the ground layer and a conductive connecting piece are disposed on a reverse side of the base, and the signal strip line feeding network comprises two one-to-two power splitters; and two output ends of each one-to-two power splitter are respectively coupled to two corresponding feeding plates, and an input end of the one-to-two power splitter is electrically coupled to the ground layer by using the conductive connecting piece.

11. The dual-polarized radiating element according to claim 1, wherein the feeding plate is L-shaped.

12. The dual-polarized radiating element according to claim 1, wherein the base is further provided with an elastic mechanical part for fastening the base.

13. The dual-polarized radiating element according to claim 1, further comprising a metal mechanical part that is integrated into the insulated support structure as a whole and that is located above the insulated support structure, wherein the metal mechanical part is configured to perform electrical performance debugging on the dual-polarized radiating element.

14. A dual-polarized radiating element of an antenna comprising:

an insulated support structure comprising a top part, a base, and an intermediate supporting piece that connects the top part and the base, the insulated support structure being a solid structure, and at least two radiating arm groups conformal to the insulated support structure, and feeding mechanisms corresponding to the radiating arm groups, wherein +/−45 orthogonal polarization is formed between the radiating arm groups or between two radiating arms comprised in the radiating arm group, wherein the feeding mechanism comprises a balun and a feeding plate, wherein a plane on which the balun is located is parallel to a plane on which the feeding plate is located, one end of the balun is electrically coupled to a corresponding radiating arm group, and another end of the balun is electrically coupled to a ground layer, and wherein the feeding plate is coupled to an electric lead on the base of the insulated support structure, wherein a second through-hole and a conductive connecting piece are disposed on the base, the base is fastened to the ground layer by using the second through-hole and a fastening piece, and the ground layer comprises a reflection panel or a suspended strip line feeding network.

15. The dual-polarized radiating element according to claim 14, wherein the ground layer is the suspended strip line feeding network, the suspended strip line feeding network comprises a cavity and a signal line that is suspended in the cavity, and a third through-hole is provided on a side of the cavity and the signal line;

correspondingly, the conductive connecting piece is a probe-type conductive connecting piece; and the probe-type conductive connecting piece is electrically coupled to the signal line through the third through-holes on the cavity and the signal line.

16. The dual-polarized radiating element according to claim 14, wherein the ground layer is the suspended strip line feeding network, the suspended strip line feeding network comprises a cavity and a signal line that is suspended in the cavity, and a fourth through-hole is provided on a side of the cavity; and correspondingly, the conductive connecting piece is electrically coupled to the signal line through the fourth through-hole, and the conductive connecting piece is a mushroom-shaped conductive connecting piece or a probe-type conductive connecting piece.

17. An antenna comprising:

an independent array comprising a dual-polarized radiating element that comprises an insulated support structure comprising a top part, a base, and an intermediate supporting piece that connects the top part and the base, the insulated support structure being a solid structure, and at least two radiating arm groups conformal to the insulated support structure, and feeding mechanisms corresponding to the radiating arm groups, wherein +/−45 orthogonal polarization is formed between the radiating arm groups or between two radiating arms comprised in the radiating arm group, wherein the feeding mechanism comprises a balun and a feeding plate, wherein a plane on which the balun is located is parallel to a plane on which the feeding plate is located, one end of the balun is electrically coupled to a corresponding radiating arm group, and another end of the balun is electrically coupled to a ground layer, and wherein the feeding plate is coupled to an electric lead on the base of the insulated support structure.

18. A base station, wherein the base station comprises the antenna according to claim 17.

19. A communications system, wherein the communications system comprises the base station according to claim 18.

* * * * *